United States Patent [19]

Metzenthin

[11] 4,276,867

[45] Jul. 7, 1981

[54] FUEL ATOMIZING DEVICE

[76] Inventor: Dieter W. Metzenthin, 5916 Wayburn, Detroit, Mich. 48224

[21] Appl. No.: 21,992

[22] Filed: Mar. 19, 1979

[51] Int. Cl.[3] ..... F02M 29/00

[52] U.S. Cl. ..... 123/590; 261/79 R

[58] Field of Search ..... 123/141; 261/79 R

[56] References Cited

U.S. PATENT DOCUMENTS

| | | | |
|---|---|---|---|
| 1,309,719 | 7/1919 | Curtis | 261/79 R |
| 1,857,070 | 5/1932 | Thomas | 123/141 |
| 3,332,231 | 7/1967 | Walsh | 261/79 R |
| 3,467,072 | 9/1969 | Toesca | 123/141 |
| 3,682,390 | 8/1972 | Cheshire et al. | 239/399 |
| 3,730,160 | 5/1973 | Hughes | 123/141 |
| 3,977,374 | 8/1976 | August | 123/141 |
| 4,085,717 | 4/1978 | Wilmann et al. | 123/141 |
| 4,130,099 | 12/1978 | Ferguson | 123/141 |

FOREIGN PATENT DOCUMENTS

| | | | |
|---|---|---|---|
| 881874 | 9/1971 | Canada | 123/141 |
| 991020 | 9/1951 | France | 123/141 |

*Primary Examiner*—Charles J. Myhre
*Assistant Examiner*—R. A. Nelli
*Attorney, Agent, or Firm*—Gifford, VanOphem, Sheridan & Sprinkle

[57] ABSTRACT

A fuel atomizing device is provided for use with the carburetor having an air induction tube and a fuel supply. In the preferred form the atomizing device comprises a body having an inner tubular part coaxially positioned within an outer tubular part. The inner body part, however, is spaced inwardly from the outer part thus forming a tubular chamber therebetween. One end of the chamber is closed by securing the body parts together while the other end of the chamber is open through a slot formed between the body parts. The chamber is connected to the carburetor fuel supply via a tube while the body is coaxially positioned within the carburetor air induction tube and so that its closed end faces upstream. In operation, air passing through the carburetor induction tube passes around both the inner and outer body parts and, in doing so, draws fuel from the chamber and through the slot at the other end of the body.

6 Claims, 7 Drawing Figures

FUEL ATOMIZING DEVICE

BACKGROUND OF THE INVENTION

I. Field of the Invention

The present invention relates generally to liquid atomizing devices and, more particularly, to such a device for use in the air induction tube of a carburetor for an internal combustion engine.

II. Description of the Prior Art

Although there any many different types of carburetors which are used to supply an air/fuel mixture to an internal combustion engine, most of them include a source of fuel which is fluidly connected to an air induction tube by a fuel jet. Oftentimes, the fuel jet is positioned within a venturi tube coaxially disposed within the carburetor air induction tube.

Upon operation of the internal combustion engine, the engine inducts or draws air through the carburetor air induction tube and, in doing so, continuously draws a small amount of fuel from the fuel jet. This fuel becomes intermixed with the inducted air to form an air/fuel mixture which is burned within the internal combustion engine.

These previously known fuel jets, however, typically comprise a tube having a relatively large opening which faces downstream with respect to the air induction tube. Thus, fuel is drawn from the fuel jet in relatively large droplets which, due to their relatively large size, do not become fully atomized prior to the combustion of the air/fuel mixture in the engine.

The only partial atomization of the fuel with the inducted air is disadvantageous in several different respects. First, the incomplete atomization of the fuel with the air results in incomplete combustion of the air/fuel mixture within the engine combustion chamber. As such, the unburned fuel resulting from an incomplete combustion is wastefully exhausted into the engine exhaust system. In order to burn this exhausted fuel, it has been the previous practice to employ expensive air pumps driven by the engine and having their outlet coupled to the exhaust manifold for the engine in order to complete the after burn of the fuel.

A still further disadvantage of the incomplete atomization obtained by these previously known fuel jets when they are used with internal combustion engines having a plurality of engine combustion chambers or cylinders, is that an uneven air/fuel mixture is supplied to the various combustion chambers. The uneven air/fuel mixture which is supplied to the different combustion chambers in turn causes fouling of the engine spark plugs which further decreases the overall engine performance.

Lastly, the incomplete fuel atomization and the resulting incomplete combustion adversely affects the fuel mileage capability of an automotive vehicle which is driven by the engine. The fuel economy for the internal combustion engine is particularly critical in view of the current high cost of fuel and also in view of governmental fuel economy regulations.

SUMMARY OF THE PRESENT INVENTION

The present invention overcomes the above mentioned disadvantages of the previously known carburetors by providing an improved fuel jet which greatly enhances the atomizaton of the fuel within the air inducted through the carburetor.

In brief, the fuel jet according to the preferred form in the present invention comprises a body having an inner tubular cylindrical part and an outer tubular cylindrical part. The inner body part is spaced inwardly from the outer part thus forming an annular chamber therebetween.

One end of the annular chamber is closed by flaring one end of the inner body part outwardly and attaching it to the outer body part. The other end of the annular chamber, however, is open through an annular slot and this slot is preferably more restricted in area than the annular chamber.

The annular chamber is connected by a tube to the carburetor fuel supply and the fuel jet is positioned within the carburetor air induction tube so that its closed end faces upstream with respect to the induction tube while its open end faces downstream.

As air is inducted through the carburetor air induction tube, the air passes through the interior of the fuel jet and around the outside of the fuel jet. This air flow in turn draws fuel from the restricted annular slot at the downstream end of the fuel jet and this fuel becomes intermixed and atomized within the air flow tube to form the air/fuel mixture for the internal combustion engine. Moreover, since the fuel supply slot is more restricted than the previously known fuel jets and the air is inducted around both sides of the slot, only very small droplets of fuel are drawn from the fuel jet. These small fuel droplets become rapidly and completely atomized with the inducted air and prior to the introduction of the air/fuel mixture to the internal engine combustion chambers.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
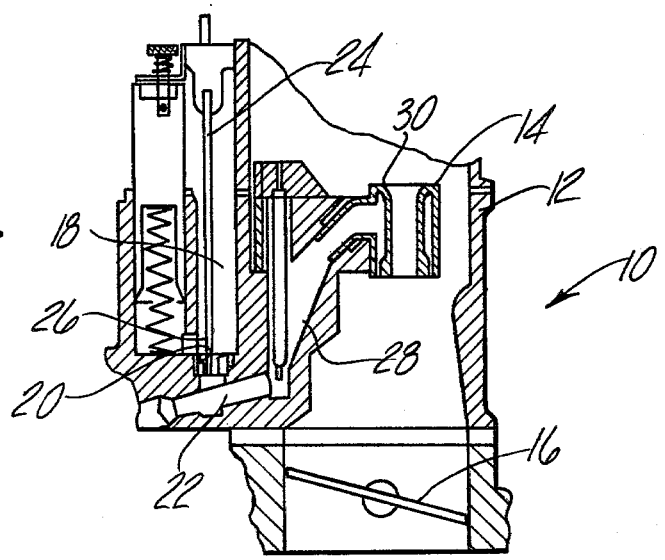
FIG. 1 is a fragmentary sectional view illustrating the fuel jet according to the present invention installed in a carburetor.

With reference first to FIG. 1, a carburetor 10 is thereshown having an air induction tube 12 with a venturi 14 positioned coaxially within the tube 12. A throttle 16 is positioned downstream from the venturi 14 and, upon activation of an internal combustion engine (not shown) and the opening of the throttle 16, air is inducted through the induction tube 12, the venturi 14 and ultimately passes to the combustion chamber of the engine.

Fuel, such as gasoline, is supplied to a chamber 18 from a carburetor fuel bowl (not shown) and this fuel passes through a main jet 20 and into a passageway 22 formed in the carburetor housing. The opening of the main jet 20, however, is controlled by a metering rod 24 having a tapered end 26 which is positioned within the main jet 20. The vertical position of the metering rod 24, and thus the supply of fuel to the passageway 22, is controlled at least in part by the position of the throttle 16 by linkage means (not shown).

The fuel passageway 22 is connected with a further passageway 28 to a fuel jet 30 positioned within the venturi 14 and it is the fuel jet 30 which supplies fuel to the air which is inducted by the engine through the carburetor induction tube 12. It is the construction of the fuel jet 30 which forms the novelty of the instant invention.

Figure 2:
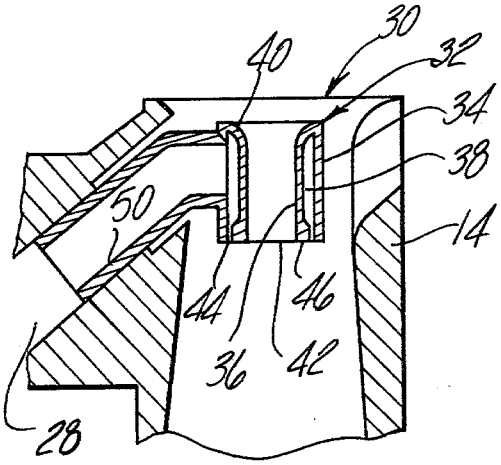
FIG. 2 is a fragmentary sectional view illustrating the fuel jet according to the present invention and enlarged for clarity.

With reference now to FIG. 2, the fuel jet 30 is thereshown in greater detail and comprises a body 32 having an outer tubular cylindrical part 34 and an inner tubular cylindrical part 36. The inner part 36 is coaxially disposed within the outer part 34 and is spaced radially inwardly from it thus forming an annular chamber 38 therebetween.

The upper end of the inner body part 36 is flared outwardly at 40 and is connected to the upper end of the outer body part 34 thus closing the upper end of the annular chamber 38. Conversely, at the downstream end 42 of the fuel jet 30, the inner part 36 is spaced inwardly from the outer part 34 thus defining an annular slot 44 between the body parts 34 and 36. In addition, for a reason which will be subsequently described in detail, the inner body part 36 preferably includes an enlarged diameter portion 46 at its downstream end 42. The enlarged diameter portion 46 protrudes outwardly so that the annular slot 44 is of a smaller cross-sectional shape, and thus more restricted than the annular chamber 38.

A tube 50 connects the annular chamber 38 with the fuel passageway 28 and thus, supplies fuel to the annular chamber 38. In addition, the tube 50 is dimensioned and shaped so as to maintain the fuel jet 30 within the coaxially aligned with the carburetor venturi 14.

In operation, as air is inducted through the carburetor air induction tube 12, and thus through the venturi 14, the inducted air passes not only around the outside of the fuel jet 30 but also through the center of the fuel jet 30. Thus, an air flow is produced around both sides of the annular slot 44 which draws fuel from the passageway 28, into the chamber 38 and out through the annular slot 44. Moreover, the annular slot 44 is much more restrictive than the previously known fuel jet openings so that only relatively small droplets of fuel are drawn from the fuel jet 30 and these small droplets become rapidly atomized with the inducted air. In practice the complete atomization of the fuel with the air is achieved prior to its introduction into the engine combustion chambers.

The enlarged diameter portion 46 at the downstream end 42 of the fuel jet 30 serves not only to restrict the annular slot 44 in the desired fashion but also increases the size of the annular chamber 38. This ensures that the flow of fuel from the passageway 28 and into the annular chamber 38 is virtually unrestricted and that a constant supply of fuel is provided to the entire annular fuel slot 44 during operation of the engine.

Figure 3:
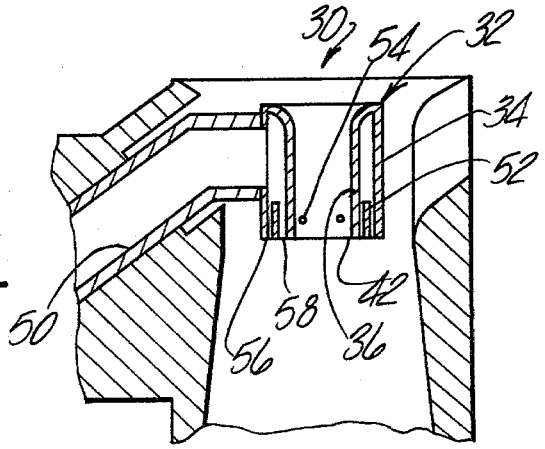
FIG. 3 is a fragmentary sectional view similar to FIG. 2 but showing a modification thereof.

A modification of the invention is illustrated in FIG. 3 in which the fuel jet 30 includes an outer body part 34 and an inner body part 36 as has been previously described. Unlike the fuel jet shown in FIG. 2, however, in FIG. 3 the fuel jet 30 includes an annular ring 52 positioned between the inner and outer body parts at the downstream end 42 of the fuel jet 30. The annular ring 52 is secured to the fuel jet body 32 by pins 54 which extend radially through at least one housing part and also through the ring 52. The ring 52, in effect, restricts and divides the fuel jet outlet opening into a pair of coaxial annular openings 56 and 58, each of which is smaller in cross-sectional area than the annular slot 44 shown in FIG. 2. The very small fuel openings 56 and 58 thus ensure that only fine droplets of fuel are inducted into the air flow stream and these fine droplets are rapidly and completely atomized.

Figure 4:
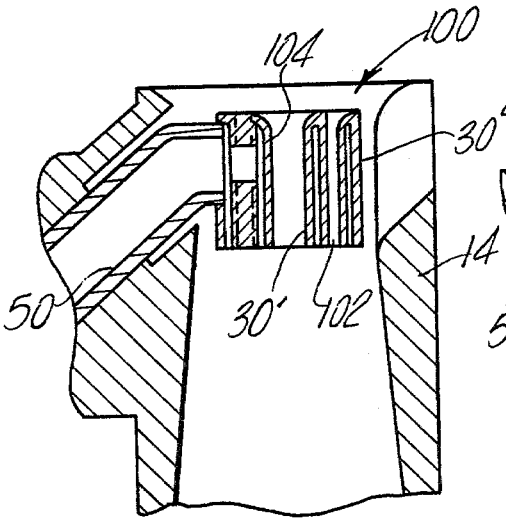
FIG. 4 is a view similar to FIG. 2 but showing a still further modification.

With reference now to FIG. 4, a still further modification of a fuel jet 100 according to the present invention is thereshown. The fuel jet 100 is similar to the fuel jet 30 shown in FIG. 2 but includes an outer fuel jet body 30 and an inner fuel jet body 30' which are coaxially secured together. In addition, the inner fuel jet body 30' is spaced radially inwardly from the outer body 30 thus forming annular inner passageway 102 therebetween. Each of the fuel jet bodies 30 and 30' has an annular chamber closed at their upper ends and open through a fuel slot at their lower end. As before, these annular chambers are connected to the source of fuel.

During the operation of the fuel jet 100, as air is inducted into the engine, the air flow passes not only through the center bore 104 and around the outside of the fuel jet 100, but also through the annular opening 102 between the body parts 30 and 30'. The annular air passageway 102 thus ensures an air flow on both the inside and outside of each fuel slot and, in this fashion, enhances the atomization of fuel.

Figure 5:
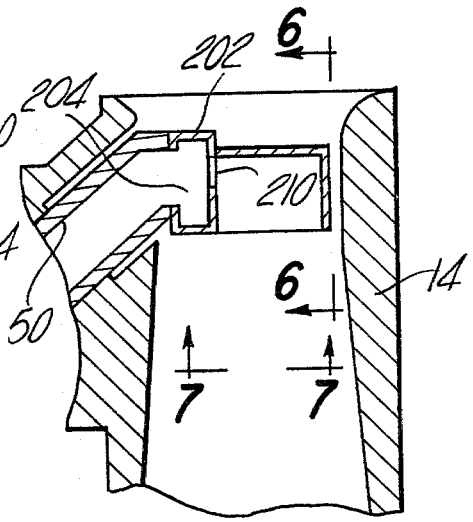
FIG. 5 is a view similar to FIG. 2 but showing yet another modification.
Figure 6:
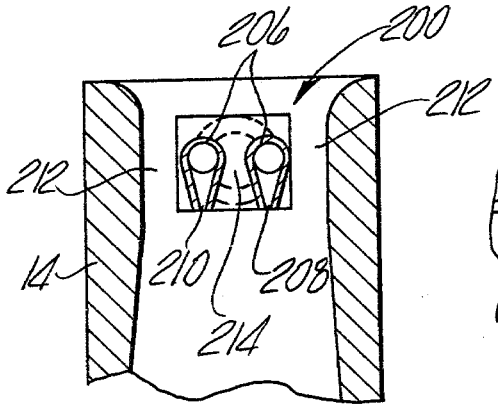
FIG. 6 is a view taken along line 6—6 in FIG. 5.
Figure 7:
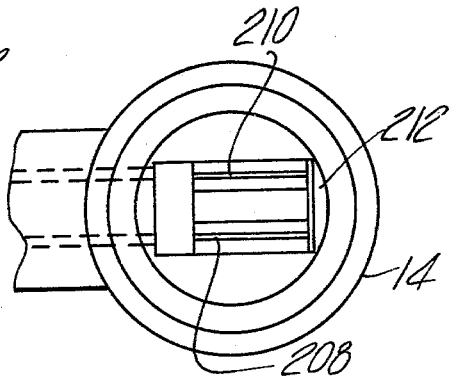
FIG. 7 is a view taken along line 7—7 in FIG. 5.

Yet another modification of the invention is illustrated in FIGS. 5 and 6 in which the fuel jet 200 includes a fuel supply housing 202 having a fuel chamber 204 which is connected to the source of fuel by the fuel supply tube 50. A pair of elongated nozzle members 206 are secured to the housing 202 so that the nozzle members 206 extend laterally across the venturi 14 in a spaced and parallel relationship. Each nozzle member 206 includes an elongated interior chamber 207 which open through a longitudinal restricted fuel slot 210. With the fuel jet 200 positioned in the venturi 14, the fuel slots face downstream with respect to the venturi 14. The interior chamber 207 of each nozzle member 206 is open via a passageway 210 to the fuel chamber 204 while a plate 212 closes the opposite end of the nozzle members 206.

During the operation of this fuel jet 200, the air inducted by the engine through the venturi 14 passes both along the outside 212 of the fuel jet and also through a passageway 214 between the spaced nozzle members 206. By this construction, the inducted air flow passes on both sides of the fuel openings 210 to enhance the atomization of the fuel.

From the foregoing it can be seen that the fuel jet according to the present invention provides a simple, inexpensive and yet totally effective means for increasing the atomization of fuel in a carburetor for an internal combustion engine. This increased atomization of fuel not only aids the overall fuel economy for the internal combustion engine but can also eliminate the necessity of external air pumps to burn the unburned fuel in the exhaust manifold.

In addition, while the fuel jet 30 according to the present invention has been described as being tubular and cylindrical in shape, it can be of different shapes, for example, rectangular, without deviation from the spirit or acope of the present invention. It will be understood that the fuel jet 30 can be formed of any suitable material, such as metal, plastic or the like and that the fuel jet 30 can be of one piece or integral construction while remaining within the intent and scope of the present invention.

Having described my invention, however, many modifications thereto will become apparent to those skilled in the art to which it pertains without deviation from the spirit of the invention as defined by the scope of the appended claims.

I claim:

1. For use with a carburetor having an air induction tube and a source of fuel, a fuel atomizing device comprising:

a tubular body having an inner tubular part and an outer tubular part, said inner part being coaxial with but spaced inwardly from said outer part and forming a tubular chamber therebetween the inner periphery of said inner part forming a through bore which extends entirely through said body, said chamber being closed at one end of the body; said inner and outer parts being spaced apart from each other at the other end of the body thus forming a slot therebetween, said slot being open to the tubular chamber;

said body being coaxially disposed within the air induction tube so that said one end of the body faces upstream and so that said slot faces downstream in said induction tube whereby air flow through the induction tube flows both around the outer periphery of the tubular body and through said body through bore and around both the inner and outer sides of said slot; and means for fluidly connecting said chamber within said fuel source.

2. The invention as defined in claim 1 wherein said chamber has a predetermined cross-sectional shape, said invention further comprising means for restricting said slot to a cross-sectional area less than the cross-sectional area of said chamber.

3. The invention as defined in claim 2 wherein said restricting means further comprises an enlarged portion attached to one of said body parts at its second end, said enlarged portion protruding toward the other body part to thereby restrict said slot.

4. The invention as defined in claim 3 wherein said enlarged portion is integrally formed with one of said body parts.

5. The invention as defined in claim 1 wherein said body parts are tubular and cylindrical in shape.

6. The invention as defined in claim 1 wherein said carburetor includes a venturi having a restricted portion and positioned in said induction tube, said body being positioned in said venturi so that its second end is positioned within the venturi restricted portion.

* * * * *

UNITED STATES PATENT AND TRADEMARK OFFICE

CERTIFICATE OF CORRECTION

PATENT NO. : 4,276,867

DATED : July 7, 1981

INVENTOR(S) : Dieter W. Metzenthin

It is certified that error appears in the above-identified patent and that said Letters Patent are hereby corrected as shown below:

Column 5, line 1, delete "acope" and insert --scope-- therefor;

Column 5, line 20, delete "through bore" and insert --throughbore-- therefor;

Column 6, line 4, delete "through bore" and insert --throughbore-- therefor.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*